United States Patent [19]

McVey

[11] 4,281,308

[45] Jul. 28, 1981

[54] THERMAL SWITCH WITH SPLIT RING CONSTRUCTION

[75] Inventor: John K. McVey, Bensenville, Ill.

[73] Assignee: Illinois Tool Works Inc., Chicago, Ill.

[21] Appl. No.: 107,750

[22] Filed: Dec. 26, 1979

[51] Int. Cl.[3] ..... H01H 37/76

[52] U.S. Cl. ..... 337/407; 337/409

[58] Field of Search ..... 337/407, 408, 409

[56] References Cited

U.S. PATENT DOCUMENTS

| | | | |
|---|---|---|---|
| 4,109,229 | 8/1978 | Plasko | 337/408 |
| 4,167,724 | 9/1979 | McCaughna | 337/407 X |
| 4,179,679 | 12/1979 | Houghland | 337/407 |
| 4,184,139 | 1/1980 | Hara | 337/407 |
| 4,189,697 | 2/1980 | Hara | 337/408 |

*Primary Examiner*—George Harris

*Attorney, Agent, or Firm*—Glenn W. Bowen; Thomas W. Buckman

[57] ABSTRACT

The thermal switch of the present invention relates to thermal switches in which an organic pellet melts at a predetermined temperature which thereby allows the switch to change from a closed to an open state. More particularly, the switch is of the axial lead type wherein one of the leads is connected to the outside of a metallic housing for the device, and the other lead passes through an insulator into the interior of the housing. A thermally-sensitive pellet is positioned in the bottom of the metallic housing and a contact member is positioned in the gap between the pellet and the head of the insulated lead. A coiled spring encircles the insulated lead and forces the contact member toward the temperature-sensing pellet. The electrically conductive contact is formed with a bottom which either engages the pellet, or a wafer which is in contact with the pellet, and a top which is partially open and has a pair of inwardly bent ends that contact the head of the insulated lead at an angle. The contact is deformed due to the applied forces so as to engage the metallic housing of the switch. When the pellet melts, the spring forces the contact member away from the head of the insulated lead and the deformed condition of the contact is relaxed so that it is no longer in electrical contact with the metallic outer housing and thus the other lead of the switch.

7 Claims, 3 Drawing Figures

Fig. 1
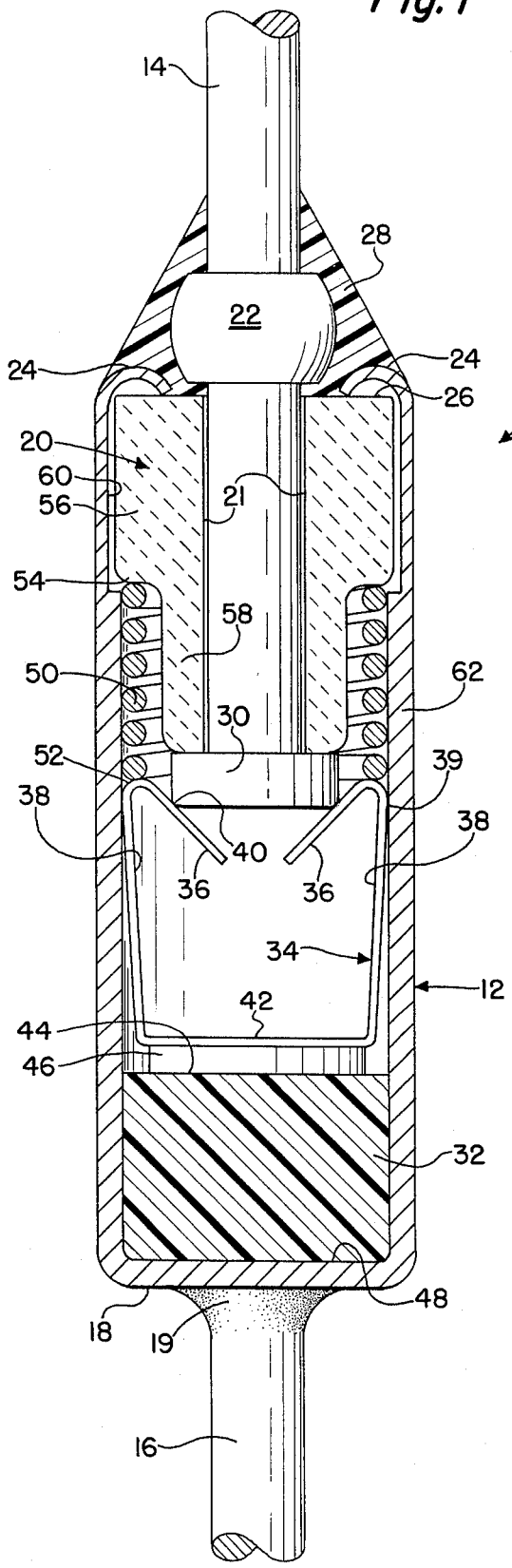
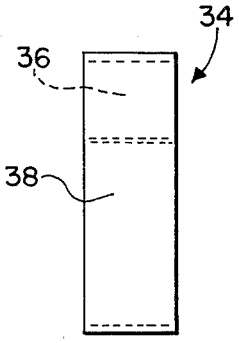
Fig. 2
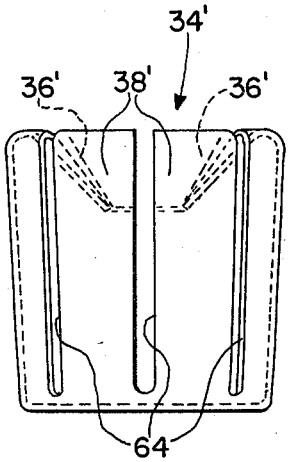
Fig. 3

THERMAL SWITCH WITH SPLIT RING CONSTRUCTION

BACKGROUND OF THE INVENTION

Although there are a number of different types of thermal cut-off switches, many of them are overly complex and utilize more parts than are commercially feasible for many applications. The construction of a simple, inexpensive, but effective thermal cut-off device using a minimum number of parts, therefore, continues to be a challenge. One attempt at providing a simplified thermal cut-off switch design utilizing a minimum number of parts is shown in Japanese Utility Model Laid-Open Publication No. 15922/72, which was filed under the name of Murata Manufacturing Company Limited. In this type of device, a hollow structure having a normally elongated oblong shape with a continuous circumference is connected directly to the insulated lead.

When the pellet is inserted into the device and the oblong contact is forced against the pellet, it is bowed outwardly until it contacts the outer metallic housing of the device. The Murata device, however, can be difficult to manufacture due to the small size of the parts and because of the necessity of either providing either a hole in the contact through which the head of the insulated lead may pass, or of some other means of permanently securing the hollow contact to the head of the insulated lead which will not be affected by high temperatures. The contact of the Murata device engages the thermal pellet at essentially a single point, thereby subjecting the pellet to a high stress which tends to destroy the integrity of the organic pellet and to reduce the reliability of the device because of premature opening of the switch.

Another design which utilizes a bowed hollow contact member with a continuous circumference or perimeter is shown in U.S. Pat. No. 4,167,724, issued Sept. 11, 1979, in the name of James R. McCaughna. The McCaughna device differs from the Japanese Murata device in that the hollow contact structure of this switch has a general rectangular shape and it is not permanently secured to the head of the insulated lead. Instead, the insulator through which the insulated lead passes has a reduced diameter portion which is encircled by a coiled spring which tends to force the contact member toward the thermally-sensitive pellet. The McCaughna thermal cut-off switch, unlike the Murata switch, has a flat contact area which engages the thermal pellet; and thus, there is a better force distribution on the thermal pellet in the McCaughna switch. However, even with this improved force disbribution, there is still a potential problem of overstressing the pellet and a premature opening of the switch. Part of this stress problem can be relieved by inserting a wafer between the hollow contact member and the organic pellet; but even with the wafer, a premature opening of the McCaughna switch may occur at a higher rate than desirable.

The thermal cut-off switch of the present invention may employ essentially the same elements as the McCaughna thermal cut-off switch, with the exception that the hollow generally rectangular-shaped, bowed contact member is replaced by a contact which does not have a continuous circumference or perimeter, but instead has a partially open top with inwardly directed surfaces that make contact with the head of the insulated lead at a point which is in close proximity to the point where the coiled spring engages the contact member. By use of this contact member, a more reliable switch is provided due to a release of excessive force on the pellet, while at the same time maintaining good electrical contact with both the housing and the insulated lead. Alternate constructions of the contact member are formed as a thin, split-ring configuration or as a cup-shaped member with an inwardly bent segmented rim so that the contact area is formed around the entire outer surface of the contact member and the entire head of the insulated lead. In the latter contact member, the sides are slotted in order to allow the melted organic material to flow through them, and thus this contact resembles a plurality of split-rings joined at the bottom.

DESCRIPTION OF THE DRAWINGS

The present invention is described by reference to the drawings in which:

FIG. 1 is a cross-sectional view of the thermal switch of the present invention;

FIG. 2 is a side view of the first embodiment of the present invention which utilizes a thin, single split-ring contact member having two inwardly bent contact arms; and FIG. 3 is a side view of a cup-shaped contact member that has an open top with an inwardly-bent segmented rim for contacting the head of the insulated lead of the device.

TECHNICAL DESCRIPTION OF THE INVENTION

The axial lead thermal switch 10 of the present invention has a pair of axial leads 14 and 16. The lead 16 is connected to the metallic conductive outer housing 12 of the device at the bottom wall 18 by means of the welded joint 19. The other lead 14 passes through an insulator 20 which has a central opening 21 which allows the lead to pass through it from the bottom upwardly as shown in FIG. 1. (in this figure the contact is labelled 34 but the Figure also applies to the contact 34' of FIG. 3). After the lead has passed through the insulator, a ring 22 is crimped onto it to prevent it from being forced inwardly by inward pressure on it. The upper open portion of the housing 12 is then bent over along the rim 24 over the top 26 of the insulator 20, and an epoxy material 28 is provided over the crimped over rim 24 and the crimped ring 22 to secure and seal off the open end of the device. An enlarged head 30 is formed on the lead 14 adjacent the bottom of the insulator 20.

A temperature-sensing pellet, which melts at a predetermined temperature and which is preferably made of an organic material 32, is inserted into the bottom of the metallic housing 12 so that there is a gap between the top surface 44 of the pellet 32 and the head 30 of the lead 14. An electrically conductive contact which is formed as a thin, split-ring contact 34, as shown in FIG. 2, or as a cup-shaped contact 34' having an open top, as shown in FIG. 3, is placed in this gap. The contacts 34 and 34' have a bottom surface 42 which is substantially flat so as to provide a good distribution of force on the top surface 44 of the pellet 32. The sides 38 or 38' of the contacts 34 and 34', respectively, taper outwardly from the bottom surface 42 to contact the inner wall of the conductive housing 12, and they may be bowed slightly when the contact 34 or 34' is positioned in the gap between the pellet 32 and the head 30. The inwardly bent pair of arms 36 of the contact 34 of FIG. 2, or the inwardly bent segment rim 36 of the contact 34' of FIG.

3, engage the head 30 of the lead 14 in a firm manner along the contact line 40 due to deformation of the contact arms or rim by the force applied by the head 30 along this line.

By providing a contact member which has non-continuous circumference or perimeter, such as the contacts 34 or 34' of FIGS. 2 and 3, the inwardly bent arms 36, of FIG. 2, or the inwardly-bent segmented rim 36 of FIG. 3, will exert a spring force against the head 30 and the inner wall of the housing 12 which allows contact member to make good contact force with both of the leads without the exertion of excessive force on the thermal pellet 32. A thin disc wafer 46 may also be inserted below the lower, generally-flat base surface 42 of the contact 34 or 34', which lies substantially parallel to the top surface 44 of the pellet 32, to further improve the stress distribution, if desired. By constructing the contact of the present invention in the aforementioned manner, the problem of premature opening of a thermal switch is substantially reduced.

In operation, the thermal switch will be in its closed state when the pellet 32 is solid, as shown in FIG. 1. Coiled spring 50 encircles the reduced diameter section 58 which necks down from the larger diameter section 56 of the insulator 20. The wall of the housing is thinner at the top section 60 so as to receive and retain the larger diameter section 56 of the insulator 20 therein. The coiled spring 50 is then compressed and positioned around the narrow diameter portion 58 so that it abuts against the surface 54 on its top end against the contact 34 or 34' in the vicinity of the bent portions 52. Thus, when the thermal pellet melts, it will flow around a split-ring contact such as the contact 34 shown in FIG. 2, or through the slots 64 of the cup-shaped contact 34' shown in FIG. 3. Consequently, when this occurs, the spring 50 will force the contact 34 or 34' downwardly towards the bottom surface 48 of the housing 12, thus relieving the deformation of the contact 34 caused by the initial force supplied by the head 30 along the contact line 40. Contact between the housing and the head 30 will then be broken as the contact 34 or 34' is forced downwardly to the bottom surface 48 by the spring 50.

What is claimed is:

1. A thermal switch comprising an elongated conductive housing having first and second ends, a first axial lead electrically connected to said conductive housing at said first end, an insulator positioned in said conductive housing at said second end, a second lead that passes through said insulator into the interior of said housing, a thermally sensitive pellet having a generally flat top surface inserted in said housing at said first end and positioned so as to leave a gap between said insulated lead and said pellet, and a compressed coiled spring that encircles at least a portion of said insulator so as to provide a spring bias force toward said sensing pellet and an electrically conductive contact member having a generally flat base surface which lies substantially parallel to said top surface of said thermal sensing pellet, side contact surfaces which contact the inside of said conductive housing, a plurality of inwardly-bent contact surfaces which contact said insulated lead and a plurality of bend portions, from which said inwardly bent contact surfaces project, in contact with said coiled spring, said inwardly-bent contact surfaces and said side contact surfaces being initially deformed as a consequence of the dimensions of said gap so that said contact makes electrical connection to said housing and said second lead.

2. A thermal switch as claimed in claim 1 wherein a thin disc wafer is inserted between said generally flat base surface of said sensing pellet and said generally flat top surface of said contact member.

3. A thermal switch as claimed in claim 1 wherein said contact member is a thin, elongated split-ring and said inwardly-bent surfaces comprise a pair of contact arms.

4. A thermal switch as claimed in claim 3 wherein a thin disc wafer is inserted between said generally flat top surface of said sensing pellet and said generally flat base surface of said contact member.

5. A thermal switch as claimed in claim 1 wherein said contact member is cup-shaped and is formed so that said inwardly bent-contact surfaces comprise a segmented rim of a plurality of contact surfaces.

6. A thermal switch as claimed in claim 5 wherein elongated vertical slots are formed in said contact member to create said segmented rim.

7. A thermal switch as claimed in claim 6 wherein a thin disc wafer is inserted between said generally flat base surface of said sensing pellet and said generally flat top surface of said contact member.

* * * * *